US006564389B1

(12) United States Patent
Laughlin

(10) Patent No.: US 6,564,389 B1
(45) Date of Patent: May 20, 2003

(54) PAN HANDLE MITT WITH ARM SUPPORT

(76) Inventor: Adam L. Laughlin, 4787 Quarton Rd., Williamston, MI (US) 48895

( * ) Notice: Subject to any disclaimer, the term of this patent is extended or adjusted under 35 U.S.C. 154(b) by 0 days.

(21) Appl. No.: 10/112,979

(22) Filed: Mar. 29, 2002

(51) Int. Cl.[7] ..... A41D 19/00
(52) U.S. Cl. ..... 2/158; 2/16; 294/25
(58) Field of Search ..... 2/158, 159, 160, 2/16, 17, 20, 161.6, 161.1, 161.5; 16/110.1, 111.1, 114.1, DIG. 12, DIG. 41; 172/370, 371; 224/218, 219, 220, 230, 232, 234; 294/1.1, 1.3, 1.4, 1.5, 19.1, 25, 26, 58, 59; 602/20, 21, 22

(56) References Cited

U.S. PATENT DOCUMENTS 929,173 A * 7/1909 Stone ..... 294/26
2,546,113 A * 3/1951 Spang ..... 294/1.1
2,710,571 A * 6/1955 Pfister ..... 172/370
3,693,973 A * 9/1972 Wattenburg ..... 473/212
4,628,544 A 12/1986 Erickson
5,716,087 A 2/1998 Backich et al.
5,878,438 A 3/1999 Ragsdale
5,878,439 A 3/1999 Waters, Jr.
5,924,752 A * 7/1999 Moody ..... 294/25
6,199,211 B1 3/2001 Franzolino
6,213,969 B1 4/2001 MacMorran et al.
6,435,284 B1 * 8/2002 Aman ..... 172/371

* cited by examiner

*Primary Examiner*—Gary L Welch
(74) *Attorney, Agent, or Firm*—Mary M. Moyne; Ian C. McLeod

(57) ABSTRACT

A forearm support device (10) for use in lifting an object (100) having a handle (102). The support device includes a U-shaped frame (12) with first, second and third supports (14, 16 and 18). The frame extends the length of the user's forearm (150) from the wrist (152) of the user to adjacent the elbow of the user. The device can be used in combination with an insulated oven mitt (20) to allow for use with hot objects. The support device enables a user to lift objects with a handle and transfers the lifting force from the user's hand and wrist to the forearm of the user.

13 Claims, 5 Drawing Sheets

PAN HANDLE MITT WITH ARM SUPPORT

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION (1) Field of the Invention

The present invention relates to a support device for use on the forearm of a user to allow for easier lifting of an object having a handle. In particular, the present invention relates to a support device which extends along the forearm of a user and supports the handle of the object when the user lifts the object using the handle.

(2) Description of the Related Art

The related art has shown various types of support devices for lifting objects. In particular, U.S. Pat. No. 5,716,087 to Backich et al shows a scoop assembly having a scoop support subassembly. The rear portion of the support subassembly has a saddle member which contacts the ventral side of a user's forearm. The fore portion of the support subassembly includes an attachment means for connecting the frame member to the handle of the scoop subassembly. When the scoop support subassembly is attached to the user's forearm, the handle of the scoop subassembly defines an angle with respect to the longitudinal axis of the user's forearm of between about 115° to about 125°. The support subassembly of this invention can only be used with a tool having a specially designed handle.

In addition, U.S. Pat. No. 5,878,438 to Raqsdale describes an insulated oven mitt having a releasable fastener for fastening a utensil.

Also of interest are U.S. Pat. Nos. 4,628,544 to Erickson and 5,878,439 to Waters, Jr. which describe mitts for protecting a server's forearm. Further, U.S. Pat. Nos. 6,213,969 B1 to MacMorran et al and 6,199,211 B1 to Franzolino show different types of hand, wrist and forearm supports.

However, there remains a need for a support device which can be used with objects having handles which transfers the force necessary to lift the object to the user's forearm during lifting of the object.

SUMMARY OF THE INVENTION

A forearm support device for use in lifting an object having a handle. The support device includes a U-shaped frame with first, second and third supports. The frame extends the length of the user's forearm from the wrist of the user to adjacent the elbow of the user. The support device enables a user to lift objects with a handle and transfers the lifting force from the user's hand to the forearm of the user.

The frame has an open proximal end and a closed, U-shaped distal end. The legs at the proximal end of the frame are flared outward away from each other and flared upward away from the plane of the frame. The distal end of the frame is angled downward away from the plane formed by the frame in a direction opposite the direction of flare of the legs at the proximal end of the frame. The first support member extends between the legs of the frame at the proximal end of the frame. The second support member extends above the plane of the frame adjacent the distal end of the frame. The second support member is in the form of a strap. The strap can be adjustable or can be of a fixed size. The third support member extends between the legs of the frame adjacent to and spaced apart from the distal end of the frame.

In one (1) embodiment when the support device is used to lift hot objects, an insulated mitt is used in combination with the support device. The underside of the mitt is provided with an opening. The distal end of the support device is inserted into the mitt and through the opening in the mitt. When the user inserts his hand into the mitt, the proximal end of the frame is adjacent his forearm. The distal end of the frame is on the outside of the mitt adjacent the user's wrist. The second support member is extended around the outside of the mitt to secure the mitt and the device to the user's forearm. When the support device is used without a mitt, a support strap can be added to the first support member. The first support strap is used to secure the support device to the forearm of the user. To use the device, the support device is positioned on the user's forearm. The user inserts the handle between the legs of the frame at the distal end of the frame until the end of the handle opposite the object is adjacent the second support member or until the user's fingers are adjacent the end of the handle nearest the object. The user then grasps the handle and lifts the object. As the user lifts the object, the handle contacts the U-shaped end of the frame and pushes downward which causes the end of the handle opposite the object to push upwards into the second support member which causes the proximal end of the frame to push upwards into contact with the user's forearm. The contact of the frame along the user's forearm transfers the lifting force from the user's wrist to the user's forearm.

The present invention relates to a forearm support device for use on a forearm of a user for supporting an object with a handle, which comprises: a U-shaped frame having a closed distal end and two legs extending from the distal end to a proximal end and adapted to support the handle through the closed distal end; a first support member mounted between the legs adjacent the proximal end and adapted to rest on an underside of the forearm; and a second support member connected between the legs intermediate the distal end and the proximal end which mounts around an upper portion of the forearm, wherein in use when the device is mounted on the forearm and wrist of the user, the handle of the object when lifted is supported adjacent an underside of the forearm.

Further, the present invention relates to a method for use on a forearm of a user for supporting an object with a handle, which comprises the steps of: providing a forearm support device for supporting an object with a handle which comprises a U-shaped frame having a closed distal end and two legs extending from the distal end to a proximal end and adapted to support the handle through the closed distal end; a first support member mounted between the legs adjacent the proximal end and adapted to rest on an underside of the forearm; and a second support member connected between the legs intermediate the distal end and the proximal end; positioning the device on the forearm of the user such that the underside of the forearm is adjacent the support members; inserting the handle between the legs of the device adjacent the closed distal end of the device; grasping the handle of the object; and lifting the object with the forearm support device while grasping the handle of the object.

The substance and advantages of the present invention will become increasingly apparent by reference to the following drawings and the description.

DESCRIPTION OF THE PREFERRED EMBODIMENTS

Figure 1:
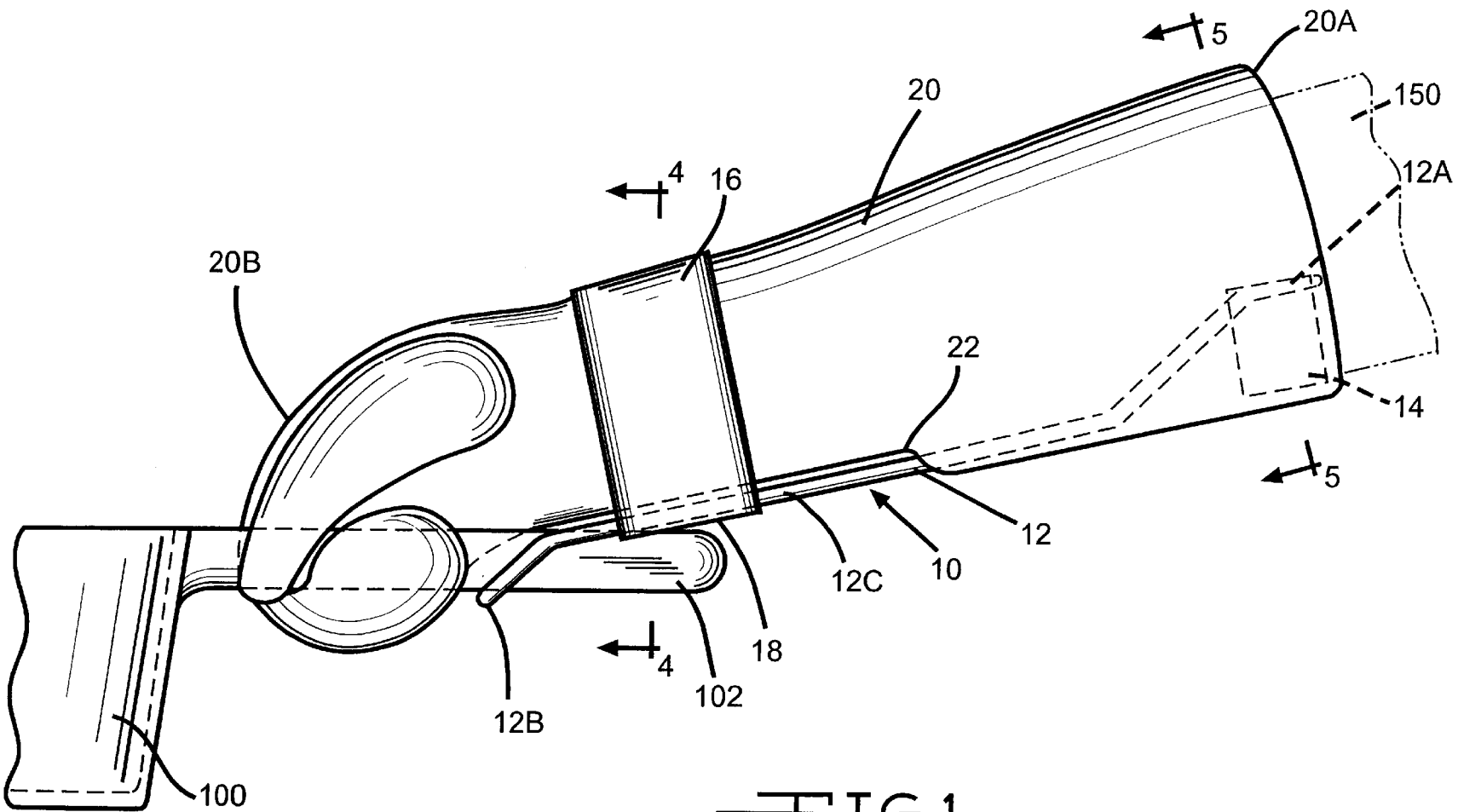
FIG. 1 is a side view of the support device 10 of one (1) embodiment having the mitt 20 and being used to lift a pan 100.
Figure 2:
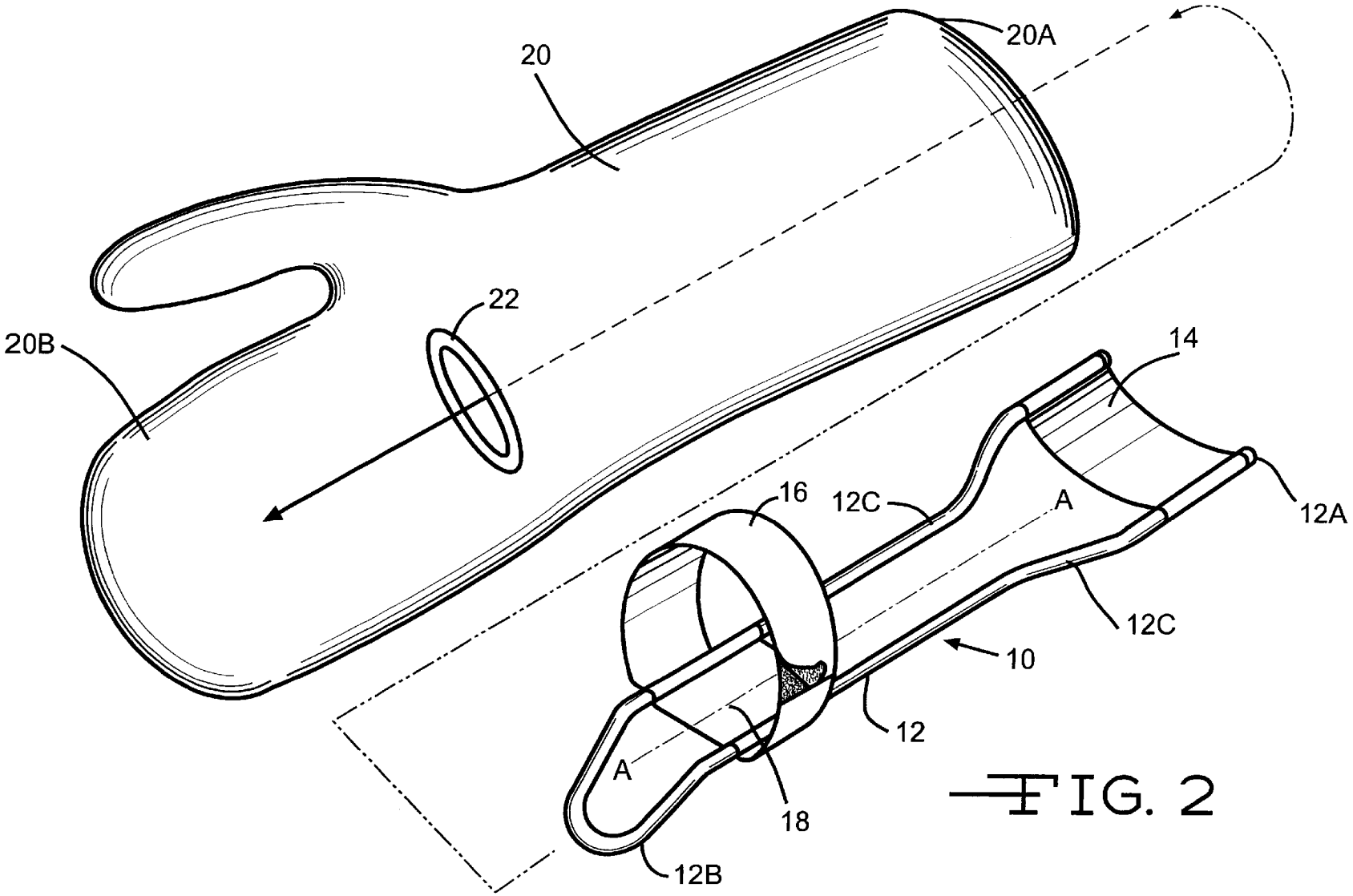
FIG. 2 is an exploded view of the support device 10 of one (1) embodiment showing the opening 22 in the underneath side of the mitt 20.
Figure 3:
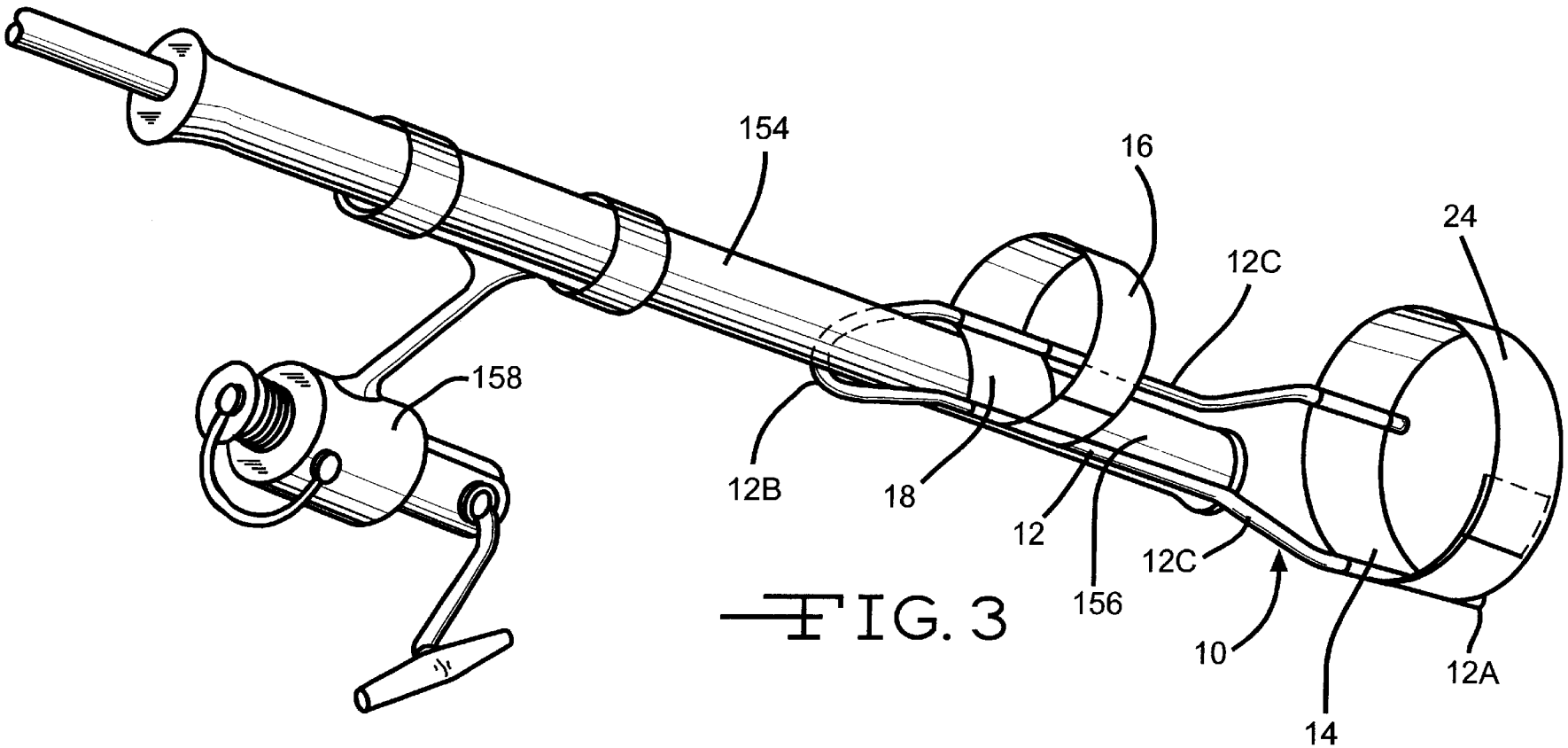
FIG. 3 is a perspective view of the support device of another embodiment in use with a fishing pole 154.
Figure 6:
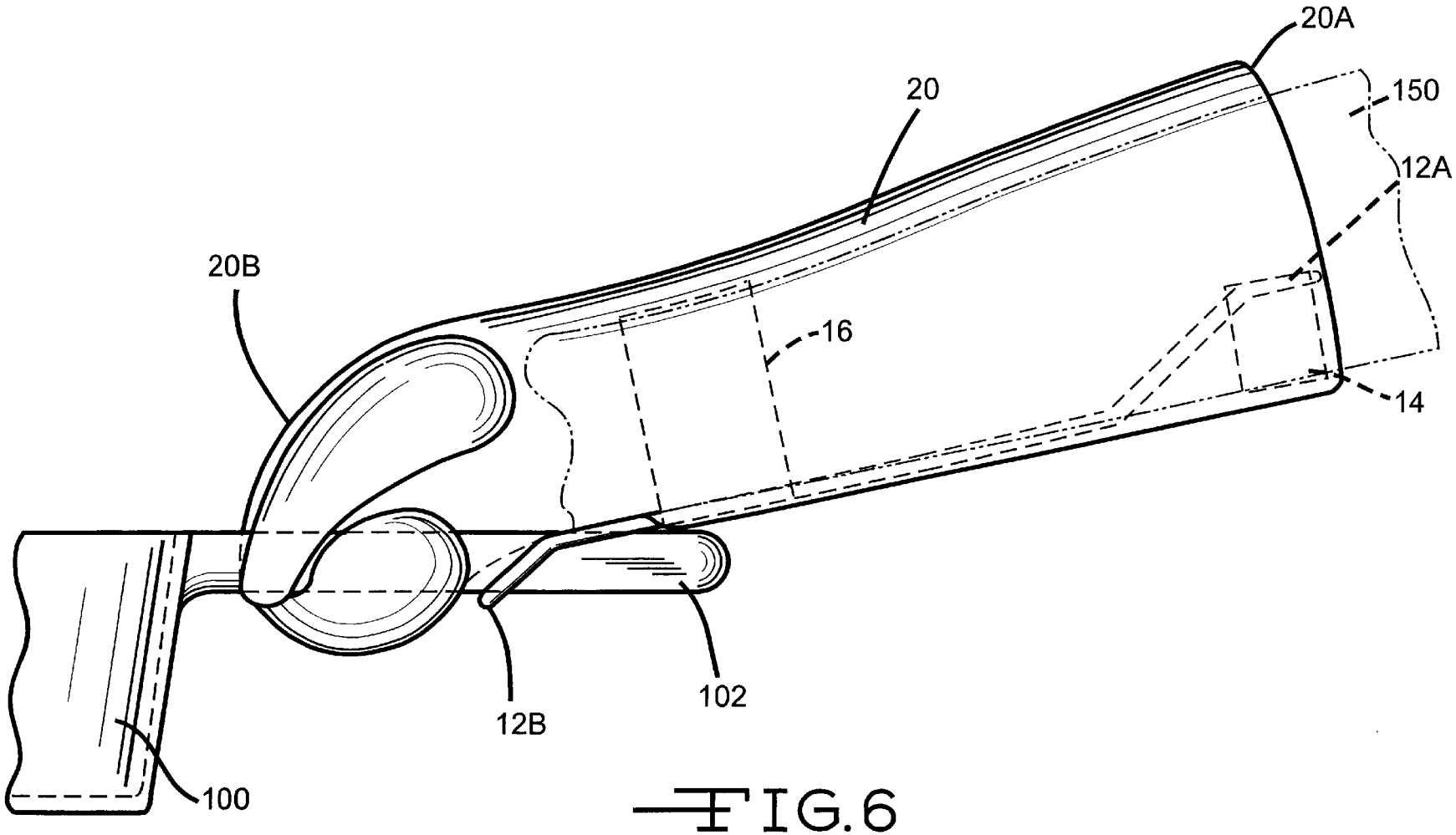
FIG. 6 is a side view of the support device 10 of one (1) embodiment having the mitt 20 and being used to lift a pan 100.

FIGS. 1 to 3 and 6 show the support device 10 of the present invention. FIGS. 1, 2 and 6 show the support device 10 of one (1) embodiment. FIG. 3 shows the support device of another embodiment. The support device 10 includes a frame 12, a first support member 14, a second support member 16 and a third support member 18. The frame 12 has a U-shape with a closed distal end 12B and legs 12C which extend toward an open proximal end 12A of the frame 12 (FIG. 2). The legs 12C of the frame 12 between the ends 12A and 12B are parallel and spaced apart and form a plane of the frame 12. It is understood that the length of the frame 12 and the distance between the legs 12C at the center portion of the frame 12 and at the proximal end 12A of the frame 12 can be varied to accommodate a variety of different users having different sized forearms 150. The legs 12C flare outward away from each other at the proximal end 12A of the frame 12 such that the legs 12C are spaced farther apart at the proximal end 12A of the frame 12 than along the remainder of the frame 12. The legs 12C at the proximal end 12A of the frame 12 also bend upward such as to be above the plane of the frame 12. The bending of the legs 12C and the distance between the legs 12C at the proximal end 12A of the frame 12 enable the legs 12C to engage the forearm 150 adjacent opposite sides of the forearm 150. End caps (not shown) can be placed on the ends of the rods at the proximal end 12A of the frame 12 to prevent injury to the user. The legs 12C at the distal end 12B of the frame 12 converge to form the U-shaped closed end. The legs 12C at the distal end 12B of the frame 12 are bent downward such as to be below the plane of the frame 12 in a direction opposite the proximal end 12A of the frame 12. The spacing of the legs 12C at the distal end 12B of the frame 12 is preferably slightly greater than the width of the handle 102 of the object 100 such that a user is able to easily insert the handle 102 of the object 100 between the legs 12C at the distal end 12B of the frame 12 but such that the handle 102 is unable to move extensively from side to side. The frame 12 is constructed of a lightweight, non-flexible, durable material. In one (1) embodiment, the frame 12 is constructed of a steel rod which is bent into the shape of the frame 12.

The first support member 14 extends between the legs 12C at the proximal end 12A of the frame 12. In one (1) embodiment, the first support member 14 extends between the portion of the legs 12C which is flared. The first support member 14 is flexible such as to accommodate a variety of sized forearms 150. In addition, the flexible nature of the first support member 14 is more comfortable against the forearm 150 of the user. The first support member 14 could also have padding to provide additional comfort for the user. In one (1) embodiment, the length of the first support member 14 is slightly greater than the space between the legs 12C at the proximal end 12A of the frame 12 such that the first support member 14 sags or curves between the legs 12C and is not taut. In one (1) embodiment, the first support member 14 is of such a width such as to extend the entire length of the flared portion of the frame 12. The width of the first support member 14 is such as to distribute the force on the user's forearm 150. The first support member 14 can extend beyond and over the ends 12A and 12B of the frame 12 at the proximal end 12A of the frame 12 to increase the comfort to the user and to prevent contact with the ends of the legs 12C of the frame 12 and to eliminate the need for end caps.

A second support member 16 is spaced adjacent the distal end 12B of the frame 12. In one (1) embodiment, the second support member 16 is spaced apart from the distal end 12B such as to not extend into the portion of the legs 12C which are bent downward. The second support member 16 is preferably a strap or cuff which extends outward from each leg 12C of the frame 12 above the plane of the frame 12 on a side opposite the bent distal end 12B of the frame 12. The second support member 16 is of a length such as to be able to extend completely around the forearm 150 of the user adjacent the wrist 152 of the user. In one (1) embodiment, the second support member 16 has a fixed size with a fixed opening which is of a size as to accommodate a variety of users having different sized forearms 150. In another embodiment, the second support member 16 is adjustable such as to allow the second support member 16 to be tightened around the user's forearm 150. In the embodiment having the mitt 20, the second support member 16 is of a size as to extend around an outside of the mitt 20 and to attach the mitt 20 and frame 12 to the forearm 150 of the user (FIG. 1). In one (1) embodiment, the second support member 16 extends from one (1) leg 12C around the user's forearm 150 to the other leg 12C but does not extend between the legs 12C and does not form a complete circle. In another embodiment, the second support member 16 forms a complete circle with the lower portion extending between the legs 12C forming the third support member 18. The second support member 16 is preferably constructed of a flexible material.

The third support member 18 extends between the legs 12C adjacent the distal end 12B of the frame 12. In one (1) embodiment, the third support member 18 does not extend into the portion of the frame 12 at the distal end 12B which is bent downward. The third support member 18 can be constructed as part of the second support member 16 or as a separate piece. The third support member 18 is constructed of a flexible material which is durable. In the embodiment using the mitt 20, the third support member 18 is also constructed of a material which is heat resistant. The length of the third support member 18 is such as to extend the complete distance between the legs 12C with some sag or curvature such that the third support member 18 is not taut across the legs 12C. The width of the third support member 18 can vary. In one (1) embodiment, the width of the third support member 18 along the frame 12 is greater than the width of the second support member 16.

In one (1) embodiment, the support device 10 is used in combination with an oven glove or mitt 20 (FIGS. 1, 2 and 6). The mitt 20 has an open forearm end 20A and a closed finger end 20B with an opening 22 on the underside of the mitt 20 spaced between the ends 20A and 20B. In one (1) embodiment, the opening 22 is positioned such that when a user is wearing the mitt 20, the opening 22 is spaced between the elbow (not shown) and the wrist 152 of a user. In another embodiment, the opening 22 is adjacent the wrist 152 of a user (FIG. 6). The mitt 20 is preferably similar to standard oven mitts having an extended forearm section. In one (1) embodiment, to use the device 10 with the mitt 20, the distal end 12B of the frame 12 of the support device 10 is inserted into the open forearm end 20A of the mitt 20 and is moved into the mitt 20 and through the opening 22 in the mitt 20. When the frame 12 of the support device 10 is correctly positioned in the mitt 20, the distal end 12B of the frame 12 is adjacent the wrist portion of the mitt 20 and the proximal end 12A of the frame 12 is adjacent the open forearm end 20A of the mitt 20 in the inside of the mitt 20. In another embodiment, the support device 10 is secured on the user's forearm 150 before the user inserts his hand and forearm 150 into the mitt 20.

In another embodiment, the first support member 14 includes an upper strap 24 which extends upward from the legs 12C above the plane of the frame 12 on a side opposite the bent distal end 12B of the frame 12. In one (1) embodiment, the upper strap 24 of the first support member 14 is adjustable to accommodate a variety of sized forearms 150 and to allow for tightly securing the proximal end 12A of the frame 12 to the forearm 150 of the user. Preferably, the upper strap 24 of the first support member 14 is constructed of a flexible material which is more comfortable for the user. The upper strap 24 can also be of a fixed size. The upper strap 24 when a fixed size could be constructed of a non-flexible material.

Figure 4:
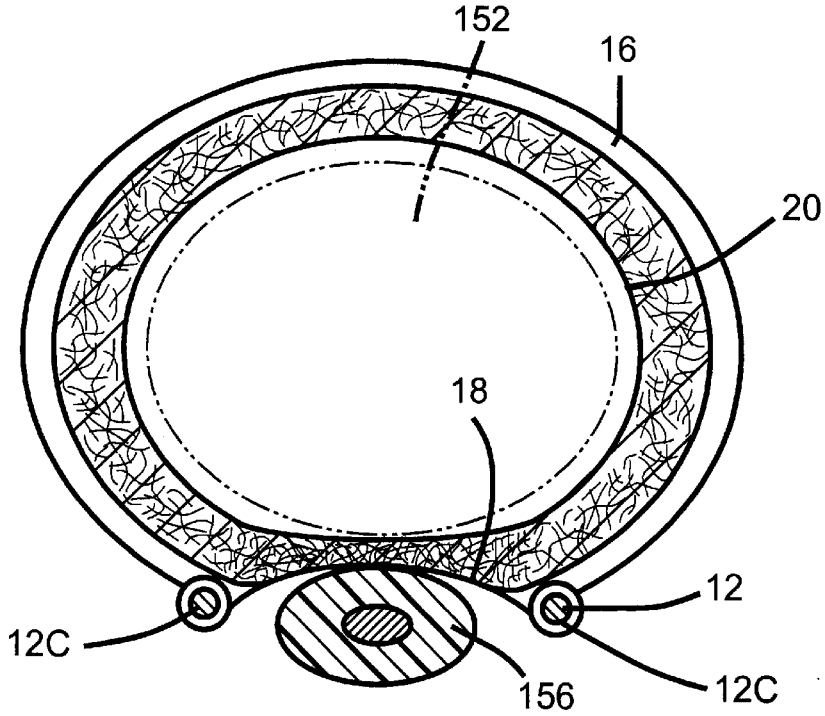
FIG. 4 is a cross-sectional view along the line 4—4 of FIG. 1 showing the handle 156 of the pan 100 contacting the third support member 18.
Figure 5:
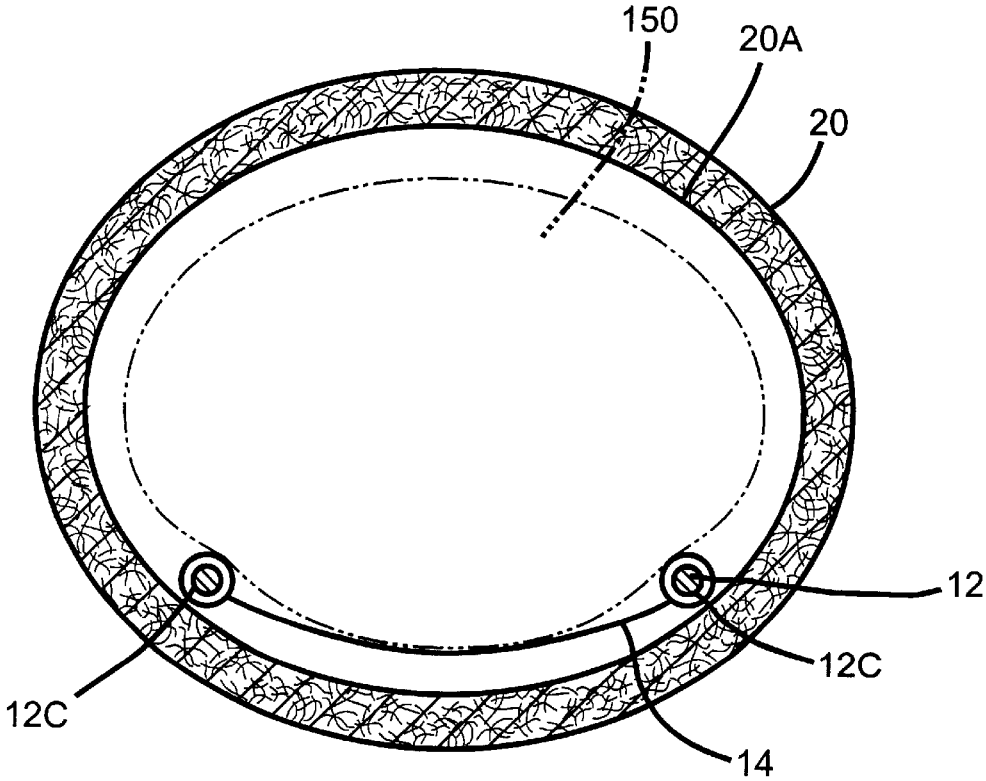
FIG. 5 is a cross-sectional view along the line 5—5 of FIG. 1 showing the proximal end 12A of the frame 12 in contact with the user's forearm 150.

In one (1) embodiment, where the device 10 is used in combination with the oven mitt 20, the support device 10 is intended to be used to lift a hot object 100 such as a pan. However, it is understood that the support device 10 with the mitt 20 can be used to lift any object 100 having a hot handle 102. In one (1) embodiment, to use the support device 10 with the mitt 20, the user first inserts a hand and forearm 150 into the open forearm end 20A of the mitt 20 having the support device 10 until the mitt 20 is correctly positioned on the user's forearm 150. In this position, the first support member 14 is adjacent the forearm 150 of the user spaced between the oven mitt 20 and the forearm 150 of the user. The distal end 12B of the frame 12 is adjacent the wrist 152 of the user with the oven mitt 20 spaced between the user's wrist 152 and the distal end 12B of the frame 12. The frame 12 of the support device 10 extends along the ventral or underside of the user's forearm 150. The user then secures the second support member 16 around the mitt 20 and forearm 150 adjacent the wrist 152. In one (1) embodiment, the second support member 16 extends from one (1) leg 12C completely around the mitt 20 and the forearm 150 of the user and around the frame 12 to the same leg 12C of the frame 12. In another embodiment, to use the support device 10 with the mitt 20, the user first positions the support device 10 on his forearm 150. When correctly positioned, the proximal end 12A of the frame 12 is adjacent the elbow of the user and the distal end 12B of the frame 12 is adjacent the wrist 152 of the user. The frame 12 of the support device 10 extends along the ventral or underside of the user's forearm 150. The user then secures the second support member 16 around his forearms 150 adjacent his wrist 152 to secure the support device 10 to his forearm 150. In one (1) embodiment, the second support member 16 extends from one (1) leg 12C around the forearm 150 of the user and around the frame 12 and back to the same leg 12C. The user then inserts his hand and forearm 150 having the support device 10 into the open forearm end 20A of the mitt 20 such that the distal end of the support device 10 extends through the opening 22 in the mitt 20 and is on the outside of the mitt 20 adjacent the wrist 152 of the user. The handle 102 of the object 100 is inserted through the legs 12C of the frame 12 adjacent the distal end 12B of the frame 12. The handle 102 is inserted such that the closed distal end 12B of the frame 12 is on a side of the handle 102 opposite the mitt 20. The handle 102 is extended into the frame 12 toward the proximal end 12A of the frame 12 until the handle 102 is adjacent to the second support member 16 (FIGS. 1 and 6). In one (1) embodiment, the handle 102 is positioned adjacent an underneath surface of the second support member 16 such that the second support member 16 is spaced between the handle 102 and the mitt 20. In another embodiment, the handle 102 is positioned adjacent the underneath surface of the mitt 20 adjacent the second support member 16 with the mitt 20 spaced between the handle 102 and the second support member 16. When the handle 102 is correctly positioned, the fingers of the user in the mitt 20 are adjacent the end of the handle 102 near the object 100 (FIGS. 1 and 6). To lift the object 100, the user grasps the handle 102 with his hand using the mitt 20. The mitt 20 enables the user to lift hot objects 100. The user then lifts the object 100 by the handle 102. As the user lifts the object 100, the handle 102 pushes down on the closed distal end 12B of the frame 12 and pushes up on the third support member 18 which forces the proximal end 12A of the frame 12 and the first support member 14 upward into contact with the forearm 150 of the user (FIGS. 4 and 5). The frame 12 of the support device 10 transfers the downward force of the object 100 caused by lifting the object 100 from the distal end 12B of the frame 12 along the frame 12 and to the proximal end 12A of the frame 12 adjacent the forearm 150 of the user. Thus, the force of lifting the object 100 is transferred from the wrist 152 of the user to the forearm 150 of the user. This creates less stress on the user's wrist 152 and enables the user to lift heavier objects 100. The spacing of the legs 12C along the central portion of the frame 12 concentrates the force of lifting on the ventral side of the forearm 150. The increased spacing of the legs 12C at the proximal end 12A of the frame 12 distributes the force around the forearm 150 such that the lifting force is not concentrated on the underside or ventral side of the forearm 150 adjacent the elbow of the user.

In one (1) embodiment, the support device 10 is used as a support for lifting a variety of different objects 100 including objects 100 which are not hot. For example, the support device 10 of this embodiment can be used as a support for a fishing pole 154 (FIG. 3). In this embodiment, the user mounts the support device 10 on his forearm 150. The device 10 is mounted on the forearm 150 such that the distal end 12B of the frame 12 is adjacent the wrist 152 of the user and the first support member 14 is in contact with the forearm 150 of the user adjacent the elbow of the user. The frame 12 extends along the ventral or underneath side of the user's forearm 150. The straps 24 and 16 of the first and second support members 14 and 16 are secured around the forearm 150 of the user. In the embodiment where the upper straps 24 and 16 are adjustable, the first and second support members 14 and 16 are preferably tightly secured around the forearm 150 of the user. In one (1) embodiment, the support member straps 24 and 16 are secured around the user's clothing on the forearm 150. The end of the fishing pole 154 adjacent the reel 158 is then inserted between the legs 12C of the frame 12 at the distal end 12B of the frame 12. The handle 156 is moved toward the proximal end 12A of the frame 12 until the handle 156 is at least adjacent the second support member 16. In one (1) embodiment, the handle 156 is extended beyond the second support member 16 toward the proximal end 12A of the frame 12 (FIG. 3). When the user lifts the fishing pole 154, the handle 156 of the fishing pole 154 contacts the closed distal end 12B of the frame 12 and pushes downward on the frame 12 at the same time the handle 156 pushes upward on the underneath side of the third support member 18. The force of the handle 156 on the distal end 12B of the frame 12 and on the third support member 18 causes the proximal end 12A of the frame 12 to be forced upward into contact with the user's forearm 150. Thus, the weight of the pole 154 and any weight attached to the pole 154 is transferred from the wrist 152 of the user to the forearm 150 of the user. The flared spacing of the legs 12C at the proximal end 12A of the frame 12 helps to distribute the force around the forearm 150 similarly to the one (1) embodiment.

It is intended that the foregoing description be only illustrative of the present invention and that the present invention be limited only by the hereinafter appended claims.

I claim:

1. A forearm support device for use on a forearm of a user for supporting an object with a handle, which comprises:

(a) two legs extending from a distal end to a proximal end and connected together at the distal end to form a U-shape and adapted to support the handle spaced between the two legs at the distal end;

(b) a first support member mounted between the legs adjacent the proximal end and adapted to rest on an underside of the forearm; and (c) a second support member connected between the legs intermediate the distal end and the proximal end which mounts around an upper portion of the forearm, wherein in use when the device is mounted on the forearm and wrist of the user, the handle of the object when lifted is supported adjacent an underside of the forearm.

2. The device of claim 1 wherein adjacent the distal end of the legs, a third support member is provided between the legs to support the handle when lifted.

3. The device of claims 1 or 2 wherein the legs at the proximal end are flared away from each other and bent upwards away from a plane of the legs to enable the legs to be on either side of the forearm.

4. The device of claims 1 or 2 wherein the distal end of the legs are bent downwards away from a plane of the legs to accommodate the handle.

5. The device of claim 1 wherein adjacent the distal end of the legs, a third support member is provided between the legs to support the handle when lifted, wherein the legs adjacent the proximal end are flared and bent upwards away from a plane of the legs to enable the legs to be on either side of the forearm and wherein the distal end of the legs are bent downwards away from a plane of the legs to accommodate the handle.

6. The support device of claim 1 wherein a glove having an open forearm end and a closed finger end is positioned over the legs, wherein the glove has an opening on an underside and wherein the glove is positioned on the legs such that the proximal end of the legs are adjacent an inside surface of the glove adjacent the open forearm end and the legs extend from the open forearm end through the opening such that the distal end of the legs are adjacent an outside surface of the glove adjacent the closed finger end of the glove.

7. The device of claim 6 wherein the second support member extends around the glove between the open forearm end and the closed finger end adjacent the outside surface of the glove.

8. A method for use on a forearm of a user for supporting an object with a handle, which comprises the steps of:

(a) providing a forearm support device for supporting an object with a handle which comprises two legs extending from a distal end to a proximal end and connected together at the distal end to form a U-shape and adapted to support the handle spaced between the legs at the distal end; a first support member mounted between the legs adjacent the proximal end and adapted to rest on an underside of the forearm; and a second support member connected between the legs intermediate the distal end and the proximal end;

(b) positioning the device on the forearm of the user such that the underside of the forearm is adjacent the support members;

(c) inserting the handle between the legs of the device adjacent the distal end of the device;

(d) grasping the handle of the object; and (e) lifting the object with the forearm support device while grasping the handle of the object.

9. The method of claim 8 wherein adjacent the distal end of the legs, a third support member is provided between the legs and wherein when the object is lifted the handle contacts the third support member which supports the handle.

10. The method of claim 8 wherein the legs of the support device adjacent the proximal end are flared and bent upwards away from a plane of the legs to enable the legs to be positioned on either side of the forearm such that during lifting of the object, the legs contact the forearm on either side to distribute a force applied to the forearm by the support device.

11. The method of claim 8 wherein the distal end of the legs are bent downwards away from a plane of the legs such that during lifting of the object, the handle is positioned and supported by the distal end of the legs.

12. The method of claim 8 wherein adjacent the distal end of the legs of the support device, a third support member is provided between the legs, wherein the legs adjacent the proximal end are flared and bent upwards away from a plane of the legs, wherein the distal end of the legs are bent downwards away from a plane of the legs and wherein during lifting of the object, the handle is supported by the distal end of the legs and the third support member and the legs contact the forearm on either side to distribute a force applied to the forearm by the support device.

13. The method of claim 8 wherein a glove having an open forearm end and a closed finger end is positioned over the legs of the device, wherein the glove has an opening on an underside and wherein the glove is positioned on the legs such that the proximal end of the legs are adjacent an inside surface of the glove adjacent the open forearm end and the legs extend from the open forearm end through the opening such that the closed distal end of the legs are adjacent an outside surface of the glove adjacent the closed finger end of the glove and wherein during step (b), the user inserts a hand and forearm into the glove and wherein in step (d), the user grasps the handle using the closed finger end of the glove such as to protect the user's hand when the handle is hot.

* * * * *